US010724806B2

(12) United States Patent
Seo

(10) Patent No.: US 10,724,806 B2
(45) Date of Patent: Jul. 28, 2020

(54) DISK BUNDLE TYPE HEAT-EXCHANGER

(71) Applicant: FROST CO., Ltd., Gimhae-si (KR)

(72) Inventor: Jin Wook Seo, Gimhae-si (KR)

(73) Assignee: FROST CO., LTD., Gimhae-si (KR)

( * ) Notice: Subject to any disclaimer, the term of this patent is extended or adjusted under 35 U.S.C. 154(b) by 13 days.

(21) Appl. No.: 15/688,008

(22) Filed: Aug. 28, 2017

(65) Prior Publication Data

US 2018/0112935 A1 Apr. 26, 2018

(30) Foreign Application Priority Data

Oct. 26, 2016 (KR) ..... 10-2016-0140507

(51) Int. Cl.

| | |
|---|---|
| ***F28F 9/007*** | (2006.01) |
| ***F28F 3/10*** | (2006.01) |
| ***F28D 9/00*** | (2006.01) |
| ***F28F 9/00*** | (2006.01) |
| *F28F 3/04* | (2006.01) |

(52) U.S. Cl.

CPC ..... *F28F 3/10* (2013.01); *F28D 9/0006* (2013.01); *F28D 9/0012* (2013.01); *F28D 9/0056* (2013.01); *F28F 9/00* (2013.01); *F28F 9/0075* (2013.01); *F28F 3/046* (2013.01)

(58) Field of Classification Search

CPC .. F28F 3/10; F28F 3/046; F28F 9/0075; F28F 9/00; F28D 9/0006; F28D 9/0012; F28D 9/0056

USPC ..... 165/157, 166, 167, 161, 159

See application file for complete search history.

(56) References Cited

U.S. PATENT DOCUMENTS

| | | | | |
|---|---|---|---|---|
| 2,183,160 A * | 12/1939 | Cox | F28D 7/1646 | 165/159 |
| 4,548,260 A * | 10/1985 | Stachura | F28D 7/1646 | 165/160 |
| 5,146,980 A * | 9/1992 | Le Gauyer | F28D 9/0012 | 165/165 |
| 6,918,433 B2 * | 7/2005 | Kontu | F28D 9/0006 | 165/135 |

(Continued)

FOREIGN PATENT DOCUMENTS

| | | | |
|---|---|---|---|
| EP | 2988085 A1 * | 2/2016 | F28F 3/044 |
| JP | S64-8063 U | 1/1989 | |

(Continued)

*Primary Examiner* — Devon Russell

(74) *Attorney, Agent, or Firm* — Korus Patent, LLC; Seong Il Jeong

(57) ABSTRACT

Disclosed herein is a disk bundle-type plate heat exchanger. In disk bundle-type plate heat exchanger, a shell housing having an internal chamber is provided with an inlet and an outlet for a heating medium and an inlet and an outlet for a heating target medium, a first heat exchange bundle, a second heat exchange bundle, . . . , and an n-th heat exchange bundle are constructed in an integrated manner by stacking heat transfer plates having heating or heating target heat transfer passages in a plurality of layers and coupling reinforcing plates to the outer surfaces of the heat transfer plates, bundle packages are introduced into the internal chamber of the shell housing to thus allow the heating medium and the heating target medium to exchange heat with each other, and a bundle guide protrudes from one side or each of both sides of each of the heat exchange bundles.

3 Claims, 6 Drawing Sheets

(56) References Cited

U.S. PATENT DOCUMENTS

| | | | | |
|---|---|---|---|---|
| 8,453,721 | B2 * | 6/2013 | Mathur | F28F 9/005 165/135 |
| 9,080,815 | B2 * | 7/2015 | Hallmann | F28D 9/0012 |
| 10,066,874 | B2 * | 9/2018 | Pitkanen | F28D 9/0006 |
| 2012/0103578 | A1 * | 5/2012 | Taylor | F28D 9/0006 165/157 |
| 2017/0254596 | A1 * | 9/2017 | Noel-Baron | F28F 3/044 |

FOREIGN PATENT DOCUMENTS

| | | | |
|---|---|---|---|
| KR | 10-2003-0029848 | A | 4/2003 |
| KR | 10-2014-0112543 | A | 9/2014 |

* cited by examiner

DISK BUNDLE TYPE HEAT-EXCHANGER

BACKGROUND

1. Technical Field

The present invention relates generally to a disk bundle-type plate heat exchanger, and more specifically to a disk bundle-type plate heat exchanger, in which a heating medium within a shell housing can sufficiently exchange heat with a heating target medium within another channel while passing through a heat exchange area within heat exchange bundles and heat transfer plates, thereby maximizing heat exchange efficiency.

2. Description of the Related Art

Generally, plate heat exchangers are configured such that a heating medium and a heating target medium exchange heat with each other while flowing through heat transfer passages between heat transfer plates composed of thin metallic plates. As shown in FIG. 1, such a plate heat exchanger is fabricated in an integrated form by welding the contact surfaces of several to several tens of heat transfer plates by using a welding flux in the state of having been superimposed on top of one another in a plurality of layers. However, the defect rate is high, and the loss of raw material to be discarded is high when defects occur. Furthermore, when the specifications (a standard or capacity) of the plate heat exchanger increase to a higher level, it becomes difficult to fabricate and produce the plate heat exchanger, the defect rate becomes even higher, and thus loss becomes significantly high.

In connection with this, Korean Patent Application No. 10-1999-0024440 (filed on Jun. 26, 1999) discloses a disk-type heat exchanger. Since the disk-type heat exchanger has been already disclosed, a detailed description thereof will be omitted. Meanwhile, this conventional technology basically includes an integrated heat transfer plate block and a separate heat transfer plate unit assembly. The integrated heat transfer plate block is fabricated by fastening a plurality of heat transfer plates through welding, and thus problems identical to those described above are expected to occur. Furthermore, the separate heat transfer plate unit assembly is expected to generate reductions in operating pressure and temperature when a gasket is inserted into heat transfer plates. In particular, the separate heat transfer plate unit assembly is problematic in that the risk of leakage is high. Furthermore, it is difficult to fabricate a product, productivity is low, and a manufacturing cost is high. Moreover, when a high-temperature heating medium is used, a problem arises in that the life span of the gasket is rapidly reduced.

Furthermore, the present applicant proposed Korean Patent No. 10-1078554 (issued on Oct. 25, 2011, and invented by an inventor identical to the inventor of the present invention) entitled "Disk-type Heat Exchanger with Reinforced Circumference," and Korean Patent Application No. 10-2015-0130775 (filed on Sep. 16, 2015, and invented by an inventor identical to the inventor of the present invention) entitled "Disk Bundle-type Package Heat Exchanger." Meanwhile, according to these conventional technologies, a heating medium leaks via a gap G between the inner bundle guides 3 of a body housing 1 and the circumferential surfaces of the heat transfer plates of bundle packages 2 and via corrugations 4, moves out of a heat exchange area within the heat transfer plates, and leaks without heat exchange with a heating target fluid in another channel (a heat transfer passage), as shown in FIG. 1. Accordingly, impurities (residues) are accumulated in the gap, and thus corrosion or damage is caused in the gap and weakness occurs. A disadvantage also arises in that a heat exchange dead zone occurs on the circumferences of the heat transfer plates, and a problem arises in that heat exchange efficiency is relatively decreased.

SUMMARY

An object of the present invention is to propose a disk bundle-type plate heat exchanger, in which bundle packages formed by stacking heat transfer plates are introduced into the internal chamber of a shell housing, upper and lower chambers are partitioned from each other by bundle guides formed on the side surfaces of the bundle packages, and the heating medium of the upper chamber can fully exchange heat via a heat exchange area (a heat transfer passage) within the heat transfer plates without leakage to the sides of the bundle packages and can then flow into the lower chamber.

Another object of the present invention is to propose a disk bundle-type plate heat exchanger, which enables bundle packages to be easily introduced into and installed at or to be easily taken out from predetermined locations within a shell housing by means of the side bundle guides of the bundle packages.

Still another object of the present invention is to propose a disk bundle-type plate heat exchanger, in which the internal chamber of a shell housing is allowed to form a shell pass by means of blocking portions provided in the upper or lower portions of heat exchange bundles, thereby increasing the time during which a heating medium stays within the shell housing and also improving heat exchange efficiency.

In order to accomplish the above objects, the present invention provides a disk bundle-type plate heat exchanger, wherein: a shell housing having an internal chamber is provided with an inlet and an outlet for a heating medium and an inlet and an outlet for a heating target medium; a first heat exchange bundle, a second heat exchange bundle, . . . , and an n-th heat exchange bundle are constructed in an integrated manner by stacking heat transfer plates having heating or heating target heat transfer passages in a plurality of layers and coupling reinforcing plates to the outer surfaces of the heat transfer plates; bundle packages modularized using the heat exchange bundles are introduced into the internal chamber of the shell housing to thus allow the heating medium and the heating target medium to exchange heat with each other; and a bundle guide protrudes from one side or each of both sides of each of the first heat exchange bundle, the second heat exchange bundle, . . . , and the n-th heat exchange bundle.

The bundle guides may be introduced into the chamber while coming into sliding contact with the inner surface of the shell housing, and may be configured to allow the heating medium, flowing into the upper chamber on an inlet side, to exchange heat with the heating target medium while passing through the heat transfer passage, and to then flow into the lower chamber on an outlet side.

The first heat exchange bundle, the second heat exchange bundle, . . . , and the n-th heat exchange bundle may be allowed to have circumferential honeycomb structures by corrugations formed on the circumferences of the heat transfer plates, and the bundle guides may be composed of extended corrugations extended long from the side surfaces of the heat transfer plates in a vertical direction.

The bundle guides may be extended from the side surfaces of the heat transfer plates and the reinforcing plates in fan shapes.

The first heat exchange bundle, the second heat exchange bundle, . . . , and the n-th heat exchange bundle may be configured such that an upper blocking portion and a lower blocking portion are selectively formed on each of the reinforcing plates, thereby forming a shell pass which allows the heating medium to flow through the upper chamber and the lower chamber in a zigzag manner.

The shell housing may be provided with guide rails configured to guide the bundle guides on the inner surface thereof.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Figure 1:
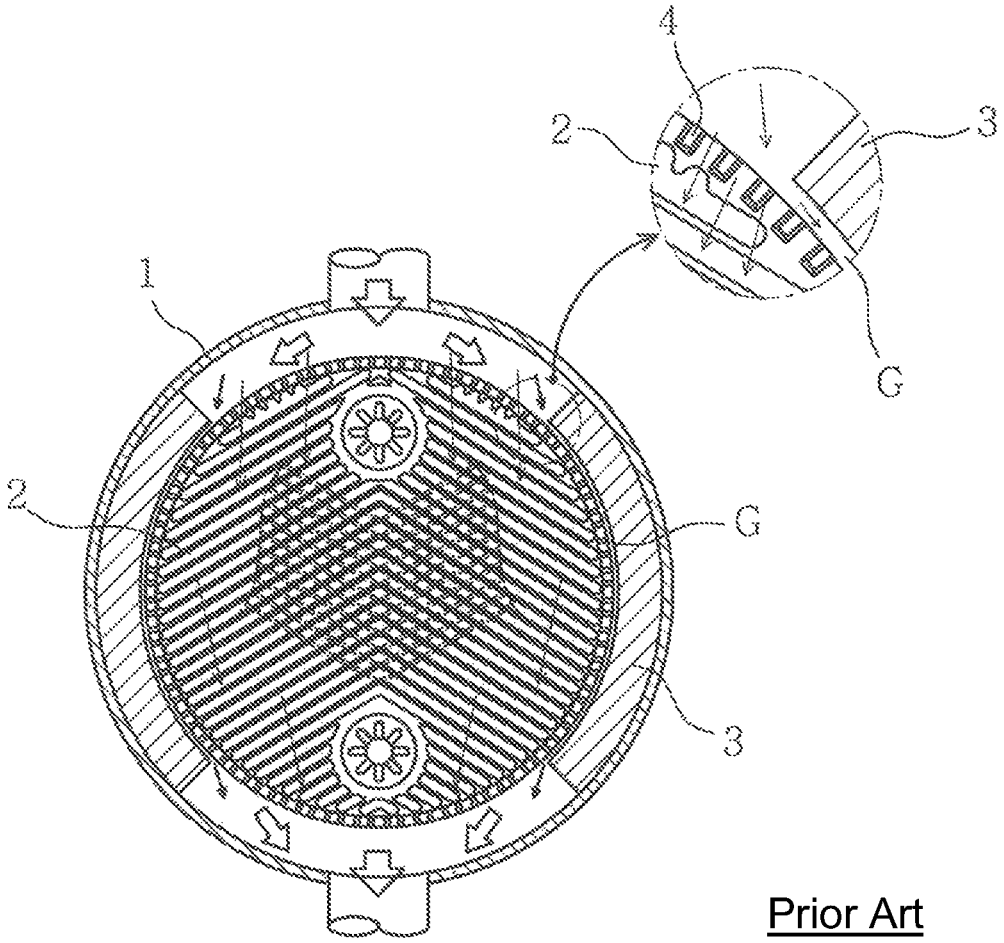
Prior Art FIG. 1
FIG. 1 is a sectional view showing the interior of a conventional disk bundle-type plate heat exchanger.

Embodiments of the present invention will be described in detail below with reference to the accompanying drawings. Referring to the drawings, a disk bundle-type plate heat exchanger according to the present invention is configured such that a shell housing 10 having an internal chamber 11 is provided with an inlet 14 and an outlet 15 for a heating medium and an inlet 16 and an outlet 17 for a heating target medium, a first heat exchange bundle 20-1, a second heat exchange bundle 20-2, . . . , and an n-th heat exchange bundle **20-*n* are constructed in an integrated manner by stacking heat transfer plates 22 having heating or heating target heat transfer passages 24 in a plurality of layers and coupling reinforcing plates 30 to the outer surfaces of the heat transfer plates 22, bundle packages 20 modularized using the heat exchange bundles are introduced into the internal chamber 11 of the shell housing 10 to thus allow the heating medium and the heating target medium to exchange heat with each other, and a bundle guide 28 protrudes from one side or each of both sides of each of the first heat exchange bundle 20-1, the second heat exchange bundle 20-2, . . . , and the n-th heat exchange bundle 20-*n***.

The disk bundle-type plate heat exchanger having the above-described features according to the present invention includes the shell housing 10, assembly-type bundle packages modularized for respective heat exchange bundles, and leakage prevention means 40. The shell housing 10 accommodates the assembly-type bundle packages 20 in the internal chamber 11 thereof.

The shell housing 10 has a hollow cylindrical shape, and includes the heating medium inlet 14 in the top thereof, the heating medium outlet 15 in the bottom thereof, and the heating target medium inlet 16 and the heating target medium outlet 17, configured to communicate with port holes, in one side thereof. The shell housing 10 is configured to be selectively opened and closed in such a manner that a flange is formed around the opening portion of one side or each of both sides thereof and a blind 12 and a hinge 13 are coupled to the flange.

Each of the bundle packages 20 includes one or more disk heat exchange bundles, and the number of a first heat exchange bundles 20-1, a second heat exchange bundles 20-2, a third heat exchange bundles 20-3, . . . , and an n-th heat exchange bundle **20-*n*** is selectively determined. This enables the number of disk heat exchange bundles to be selectively applied according to the specifications (a standard, processing capacity, etc.) of the plate heat exchanger, and facilities a change, addition and subtraction in design.

The first heat exchange bundle 20-1, the second heat exchange bundle 20-2, . . . , and the n-th heat exchange bundle **20-*n* are integrated in such a manner that a plurality of heat transfer plates 22 are stacked in a plurality of layers to thus form channels and contact surfaces are brazed to each other. The number of heat transfer plates 22 preferably ranges from 2 to 30, and most preferably ranges from 5 to 20. Furthermore, the reinforcing plates 30 are brazed to and integrated with the outer surfaces of the heat transfer plates 22 in the state of being in close contact with the outer surfaces. Furthermore, the heat transfer plates 22 include port holes 25 in the upper and lower peripheral portions, heat transfer passages 24 on the overall surfaces thereof, i.e., heat exchange areas, and corrugations 26 on the circumferences thereof. The heat transfer passages 24** include a heating heat transfer passage configured such that a heating medium flows therethrough, and a heating target heat transfer passage configured such that a heating target medium flows therethrough. For example, the heating medium flowing via the chamber and the heating target medium flowing via the port holes exchange heat while flowing through the respective heat transfer passages.

A bundle guide 28 is formed on one side or each of both sides of each of the first heat exchange bundle 20-1, the second heat exchange bundle 20-2, and the n-th heat exchange bundle **20-*n***.

According to the present invention, while coming into sliding contact with the inner surface of the shell housing 10, the bundle guides 28 allow the heating medium, introduced into the chamber 11 and flowing into an upper chamber 11-1 on an inlet side, to exchange heat with the heating target medium while passing through the heat transfer passage 24 and to flow into a lower chamber 11-2 on an outlet side.

In other words, the heat exchange bundles can be smoothly introduced into predetermined locations because the bundle guides 28 come into sliding contact with the inner surface of the shell housing, and the chamber 11 is divided into the upper chamber 11-1 on the inlet side and the lower chamber 11-2 on the outlet side. Accordingly, the heating medium flowing into the upper chamber 11-1 via the inlet 14 fully passes through the heating heat transfer passage and flows into the lower chamber 11-2, thereby ensuring sufficient heat exchange and maximizing heat exchange efficiency.

According to the present invention, the first heat exchange bundle 20-1, the second heat exchange bundle 20-2, . . . , and the n-th heat exchange bundle **20-*n* are provided with circumferential honeycomb structures by the corrugations 26 formed on the circumferences of the heat transfer plates 22, and the bundle guides 28 are composed of extended corrugations 27 extended long in a vertical direction beside the heat transfer plates 22. In other words, the outside circumferences of the heat transfer plates 22 are repeatedly bent in trapezoidal shapes so that the corrugations 26 constituting the outside circumferences of the heat transfer plates 22** have honeycomb structures. When the heat transfer plates are superimposed on top of one another in a vertical direction, hexagonal honeycomb structures are formed, as shown in the drawing, thereby reinforcing the circumferences of the heat exchange bundles and increasing strength and durability.

Figure 2:
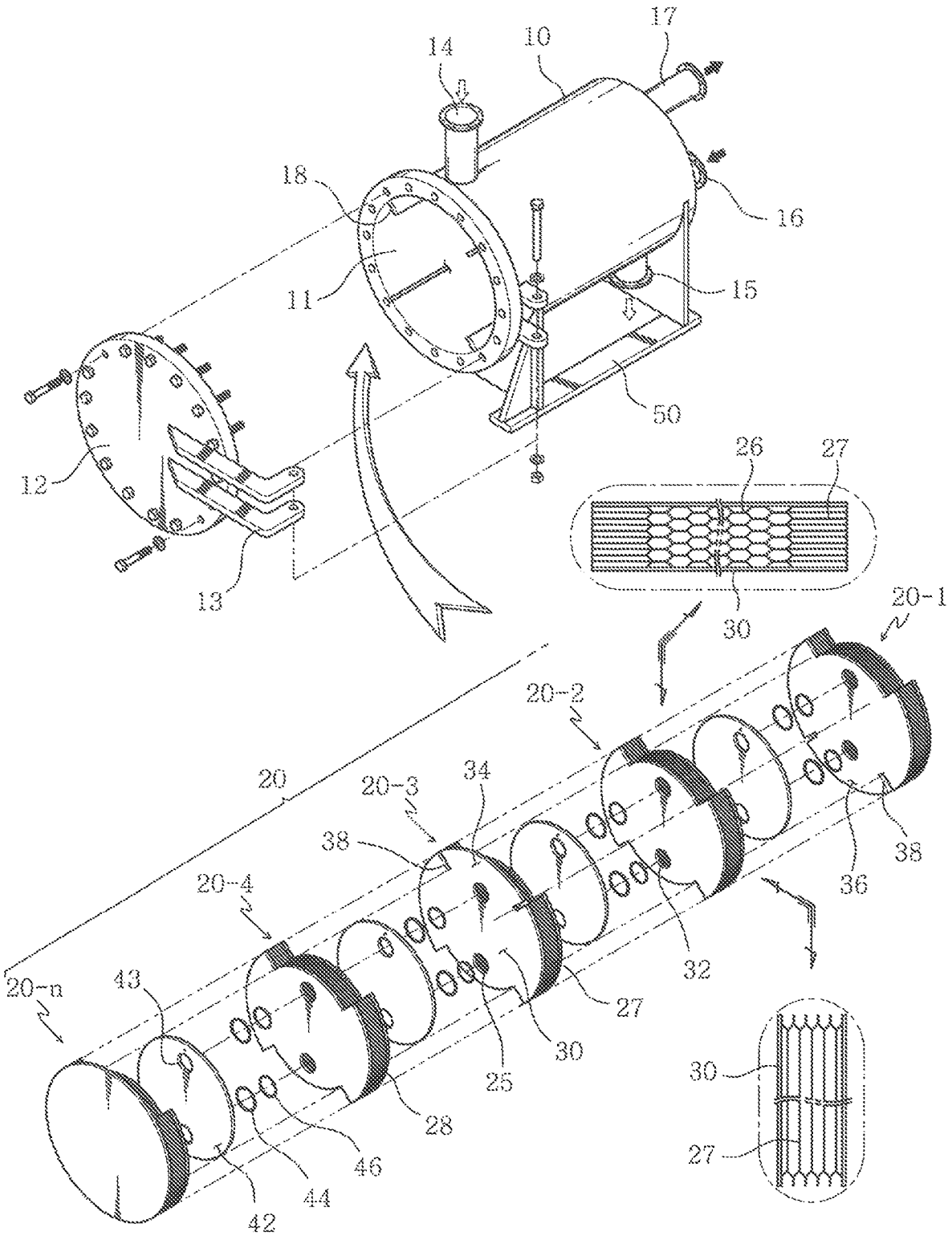
FIG. 2 is an exploded perspective view showing a disk bundle-type plate heat exchanger according to a preferred embodiment of the present invention.

In the bundle guides 28, the corrugations 27 having honeycomb structures form the extended corrugations 27 extended long in a vertical direction, as shown in FIG. 2, and thus the inner heat exchange area of the heat transfer plates are completely blocked from an outer chamber by the extended corrugations 27. Therefore, the heating medium of the upper chamber and the lower chamber fully flows into spaces inside the heat transfer plates, and sufficiently exchange heat via the heat exchange area.

Meanwhile, the heat transfer plates 22 and the corrugations 26 are disclosed in detail in Korean Patent No. 10-1078554 (issued on Oct. 25, 2011, and invented by an inventor identical to the inventor of the present invention) entitled "Disk-type Heat Exchanger with Reinforced Circumference," which was mentioned in the section "Description of the Related Art." According to this patent, the outer circumferences of the heat transfer plates are reinforced by forming wave-shaped corrugations on the outer circumferences of the heat transfer plates, and the corrugations (depressions and protrusions) are brazed to each other. It is preferred to form a quadruple welded structure by welding the corrugations with the corrugations (depressions and protrusions) of an adjacent heat transfer plate with the heat transfer plates superimposed on top of one another in a vertical direction.

According to the present invention, the bundle guides 28 are extended from the side surfaces of the heat transfer plates 22 and the reinforcing plates 30 in fan shapes. The bundle guides 28 protrude from the side surfaces of the heat exchange bundles in fan shapes. Accordingly, the bundle guides 28 allow the bundles and the bundle packages to be stably assembled in a balanced manner within the housing, and guide the heating medium entering from the upper heating medium inlet through downward flowing along the heating heat transfer passage, thereby maximizing heat exchange efficiency. Furthermore, the bundle guides 28 ensure smooth entrance into and exit from the chamber while coming into sliding contact with the inner surface of the shell housing, and a predetermined mechanical tolerance is provided between each of the heat transfer plates and a corresponding one of the bundle guides.

Figure 3:
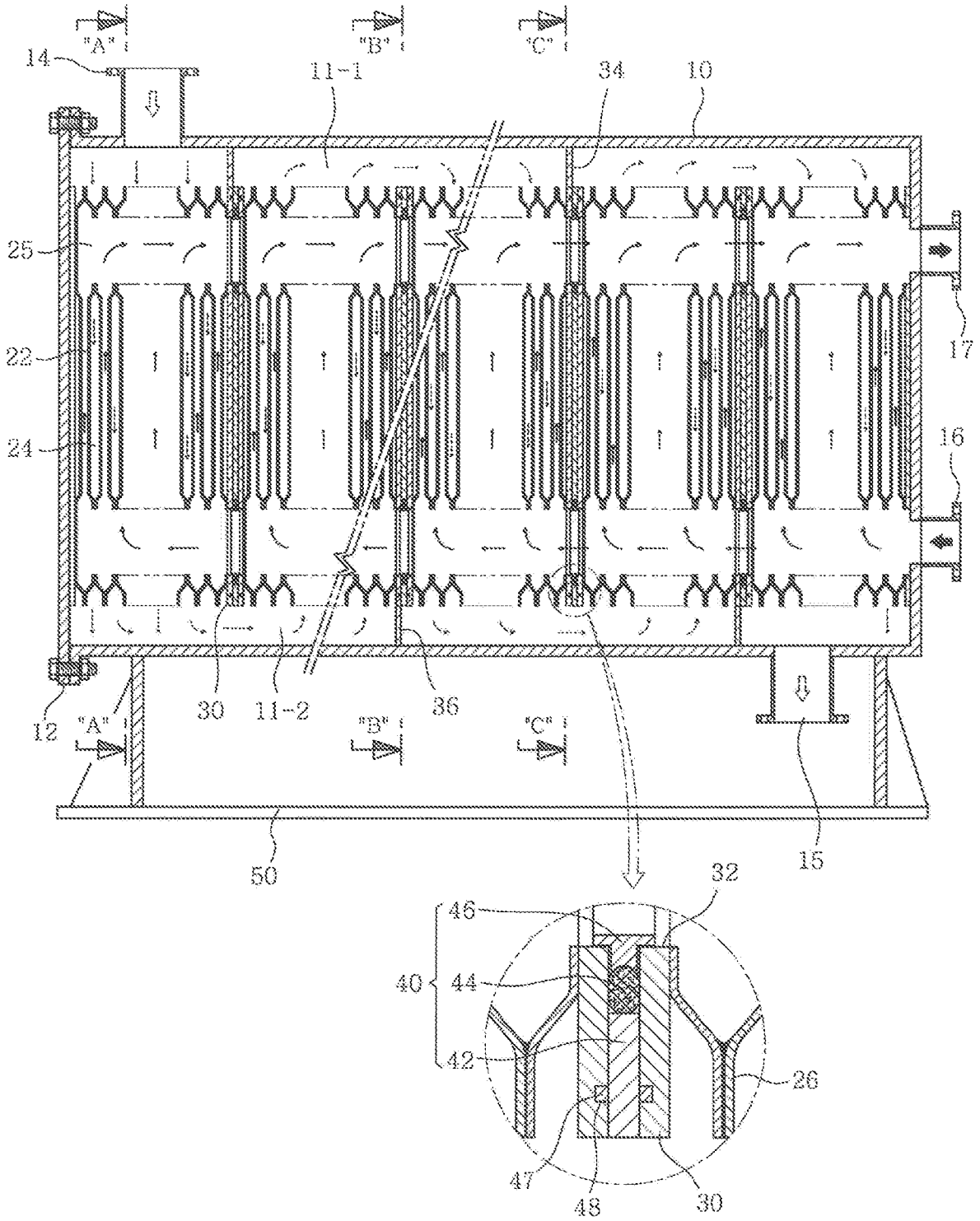
FIG. 3 is a sectional view showing the interior of the disk bundle-type plate heat exchanger.
Figure 4:
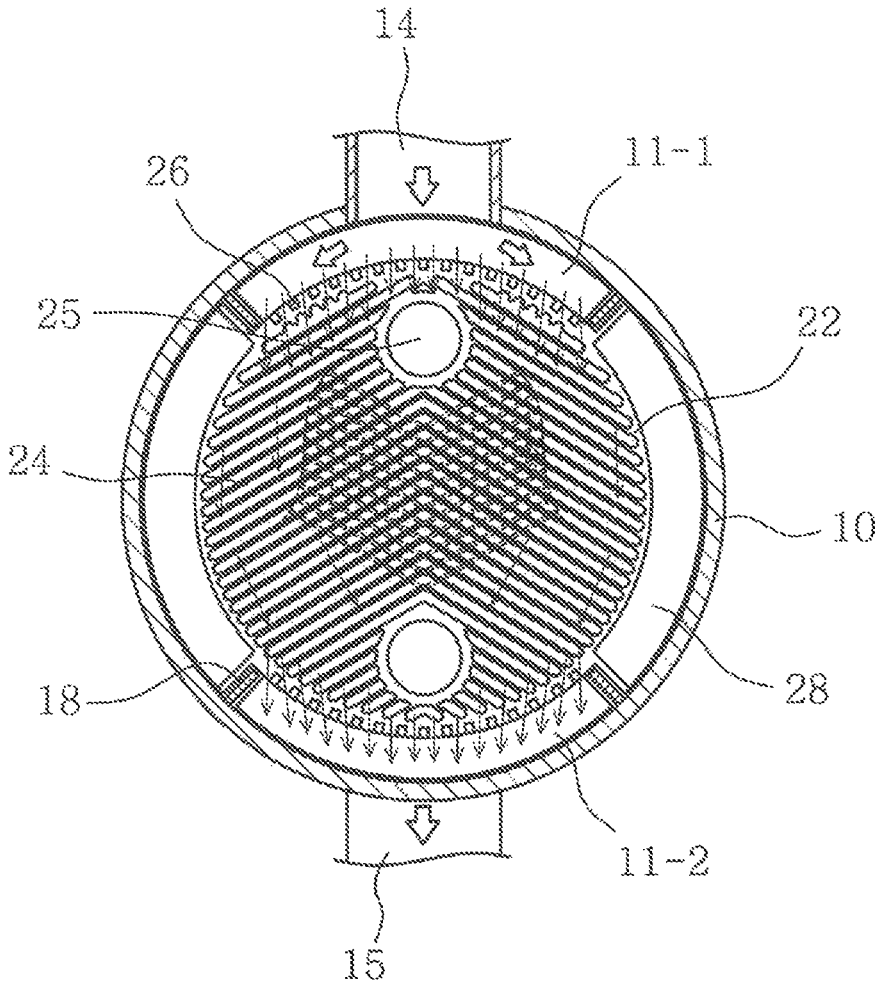
FIG. 4 is a side sectional taken along line A-A of FIG. 3.
Figure 5:
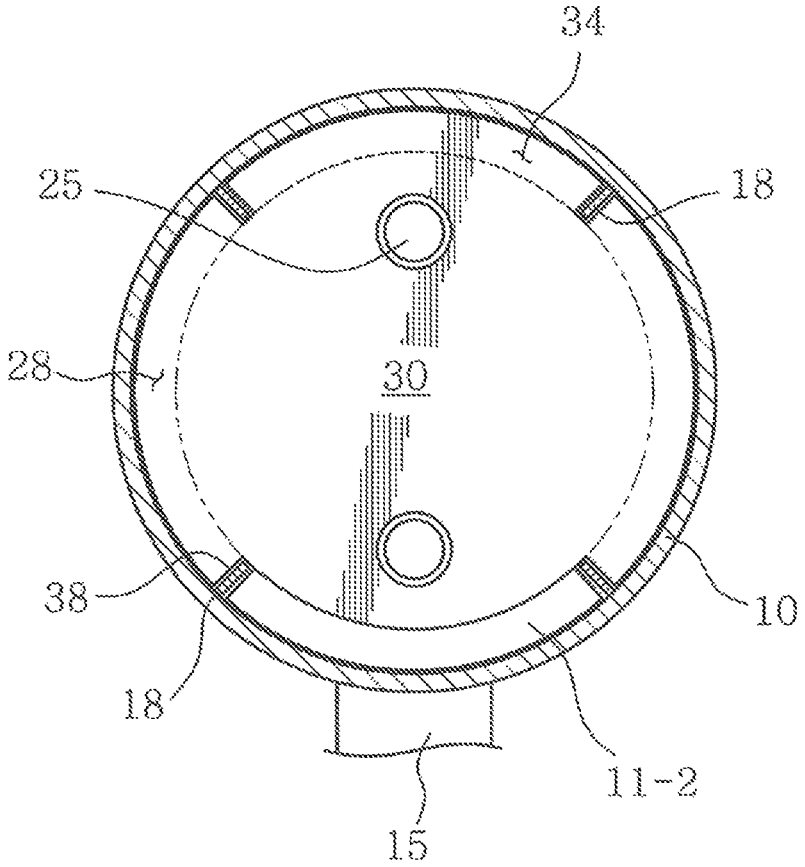
FIG. 5 is a side sectional taken along line B-B of FIG. 3.
Figure 6:
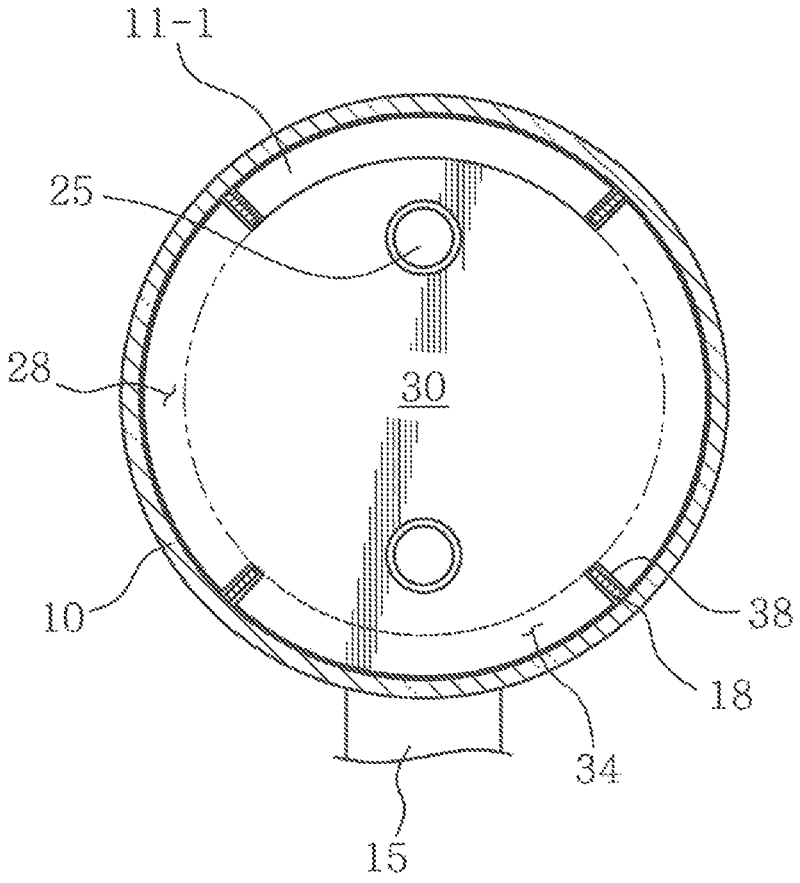
FIG. 6 is a side sectional taken along line C-C of FIG. 3.

According to the present invention, the first heat exchange bundle 20-1, the second heat exchange bundle 20-2, . . . , and the n-th heat exchange bundle **20-*n* are configured such that an upper blocking portion 34 and a lower blocking portion 36 are selectively formed on each of the reinforcing plates 30, thereby forming a shell pass which allows the heating medium to flow through the upper chamber 11-1 and the lower chamber 11-2 in a zigzag manner. In other words, the bundle guide 28 is formed one side or each of both sides of each of the reinforcing plates 30, and the upper blocking portion 34 or lower blocking portion 36 is formed beside the bundle guide. The shell pass allows the heating medium of the chamber to passes through a corresponding one of the heat exchange bundles while flowing downward by being blocked by a corresponding one of the upper blocking portions 34 and flowing upward by being blocked by a corresponding one of the lower blocking portions 36. More specifically, as shown in FIG. 3, the heating medium flowing into the upper chamber 11-1 via the inlet primarily exchanges heat while passing through the foremost n-th heat exchange bundle 20-*n*, is introduced to another heat exchange bundle through the lower chamber 11-2, exchanges heat again, and repeatedly exchanges heat up to the opposite first heat exchange bundle 20-1, thereby increasing heat exchange time within the limited internal chamber of the shell housing and also improving heat exchange efficiency. According to the present invention, the shell housing 10 is provided with guide rails 18 configured to guide the bundle guides 28 on the inner surface thereof. In other words, the guide rails 18 are provided on both sides of the inner surface of the shell housing 10 symmetrically with respect to a lateral line, and thus allow the heat exchange bundles to be easily introduced into the chamber and easily assembled at predetermined locations through the guidance of the bundle guides. Accordingly, the bundle guides 28 are radially formed around the center of the shell housing 10 and the guide rails 18 are extended long in the length direction of the shell housing, and are inserted into and come into sliding contact with guide slits 38 formed in the bundle guides 28 of the reinforcing plates 30** or the circumference of the heat exchange bundles.

Next, leakage prevention means 40 are provided between the first heat exchange bundle 20-1, the adjacent second heat exchange bundle 20-2, . . . , and the other n-th heat exchange bundle **40-*n*, and maintain the water tightness. Each of the leakage prevention means 40 includes: a connection plate 42 configured to be inserted between each adjacent two of the first heat exchange bundle 20-1 to the n-th heat exchange bundle 20-*n*, and to have a ring hole 43 communicating with the port hole 25; an O-ring 44 configured to be inserted into the ring hole 43; and a space ring 46** configured to abut the O-ring.

The first heat exchange bundle 20-1 and the second heat exchange bundle 40-2 are assembled together in such a manner that the connection plate 42 is brought into contact with the side reinforcing plate 30 of the first heat exchange bundle 20-1, the O-ring 44 and the space ring 46 are inserted into the ring hole 43, and the second heat exchange bundle 40-2 is brought into close contact with the O-ring fastened. The third heat exchange bundle 20-3, . . . , and the n-th heat exchange bundle **20-*n* are repeatedly assembled in the same method, the blind is closed after n heat exchange bundles required for the internal chamber of the shell housing have been all inserted, and pressing and fastening are performed by tightening fastening means. In this case, a connection plate 42, an O-ring 44, and a space ring 46** are also inserted between the inner surface of the shell housing or blind and the n-th heat exchange bundle, thereby preventing leakage between contact portions.

In this case, the space ring 46 has an inverted "T" shape, and is tightly fitted into the ring hole 43 in such a manner that the inner sleeve thereof is fitted into the ring hole 43. Accordingly, the sleeve of the space ring 46 has a thickness equal to smaller than that of the connection plate 42, and thus stably supports the surface of the O-ring 44. The space ring 46 has an inverted "T"-shaped section, and thus supports the O-ring 44 in the form of an inverted "ㅇ." The surface of the space ring 46 which comes into contact with the O-ring 44 is formed in a depressed shape. Furthermore, a protrusion 47 and a depression 48 which are fitted into each other are formed in the contact surfaces of the reinforcing plate 30 and the connection plate 42, and thus the protrusion is fitted into the depression 48 when the heat exchange bundles are assembled together as described above, thereby enabling the coupling portions of the connection plate 42 and the reinforcing plate 30 to be regularly fitted into each other and thus improving accuracy.

The present invention is advantageous in that the interior of the shell housing is partitioned into the upper and lower chambers by integrating the bundle guides with the side surfaces of the heat exchange bundles, the risk of the occurrence of a heat exchange dead zone attributable to the leakage of a heating medium via a gap between the bundle guides and the side surface of the shell housing is eliminated, and a heat retention phenomenon attributable to the stay of a heating medium in the gap is prevented, thereby improving heat exchange efficiency.

The present invention is advantageous in that the bundle packages can be easily introduced into and installed at or to be easily taken out from predetermined locations within the shell housing by means of the side bundle guides of the bundle packages, thereby improving workability and productivity.

The present invention is advantageous in that the shell pass is formed to allow a heating medium to flow through the upper and lower chambers in a zigzag manner by means of the blocking portions selectively formed in the upper and lower portions of the reinforcing plates, thereby increasing heat exchange time for which the heating medium passes through the heat exchange area (heat transfer passage) of each of the heat exchange bundles and also further improving heat exchange efficiency.

Although the specific embodiments of the present invention have been disclosed for illustrative purposes, those skilled in the art will appreciate that various modifications, additions and substitutions are possible without departing from the scope and spirit of the invention as disclosed in the accompanying claims.

What is claimed is:

1. A disk bundle-type plate heat exchanger, comprising:

a shell housing having an internal chamber, the shell housing including an inlet and an outlet for a heating medium and an inlet and an outlet for a heating target medium; and a bundle package comprising a series of heat exchange bundles, each of the heat exchange bundles being constructed in an integrated manner as a module by stacking heat transfer plates in a plurality of layers and by coupling reinforcing plates to outermost surfaces of the stacked heat transfer plates, contact surfaces of the stacked heat transfer plates are brazed to each other, the heat transfer plates having heating or heating target heat transfer passages; and leakage prevention means provided between adjacent heat exchange bundles, wherein each of the leakage prevention means comprises a connection plate configured to be inserted between the adjacent heat exchange bundles and to have a ring hole communicating with a port hole formed in upper or lower peripheral portion of the heat transfer plates, an O-ring configured to be inserted into the ring hole, and a space ring configured to abut the O-ring, wherein the heat exchange bundles are configured to have circumferential honeycomb structures formed by corrugations on circumferences of the heat transfer plates, and the bundle package modularized using the heat exchange bundles is disposed in the internal chamber of the shell housing to thus allow the heating medium and the heating target medium to exchange heat with each other, wherein a bundle guide protrudes from one or two partial portions of a circumferential surface of each of the heat exchange bundles, wherein the bundle guide is configured to be slidably inserted into the internal chamber while coming into contact with an inner surface of the shell housing, and is configured to allow the heating medium, flowing into an upper chamber on an inlet side, to exchange heat with the heating target medium while passing through the heat transfer passages, and to then flow into a lower chamber on an outlet side, and wherein the bundle guides comprise extended corrugations extended by a predetermined length in a radial direction from circumferential surfaces of the heat transfer plates, and wherein the shell housing is provided with guide rails on an inner surface of the shell housing, the guide rails being configured to guide the bundle guides.

2. The disk bundle-type plate heat exchanger of claim 1, wherein the bundle guides are configured such that the bundle guides extend from the circumferential surfaces of the heat transfer plates and circumferential surfaces of the reinforcing plates in fan shapes.

3. The disk bundle-type plate heat exchanger of claim 1, wherein the heat exchange bundles are configured such that an upper blocking portion or a lower blocking portion is selectively formed on each of the reinforcing plates, thereby forming a shell pass which allows the heating medium to flow through the upper chamber and the lower chamber in a zigzag manner.

* * * * *